United States Patent [19]

Looser

[11] 4,191,341

[45] Mar. 4, 1980

[54] WINDING APPARATUS AND METHOD

[76] Inventor: Gottlieb Looser, Rigistrasse 28, Zurich, Switzerland

[21] Appl. No.: 26,134

[22] Filed: Apr. 3, 1979

[51] Int. Cl.[2] ..... B65H 19/20

[52] U.S. Cl. ..... 242/56 A; 242/67.1 B

[58] Field of Search ..... 242/56 A, 56 R, 64, 242/67.1 R

[56] References Cited

U.S. PATENT DOCUMENTS

| | | | |
|---|---|---|---|
| 2,915,255 | 12/1959 | Phelps | 242/56 R |
| 3,494,566 | 2/1970 | Pawelczyk | 242/56 R |
| 3,592,403 | 7/1971 | Schmitt | 242/56 R |
| 3,727,853 | 4/1973 | Kinoshita | 242/56 A |
| 4,038,127 | 7/1977 | Bullock | 242/56 A |

*Primary Examiner*—Edward J. McCarthy

*Attorney, Agent, or Firm*—Fidelman, Wolffe & Waldron

[57] ABSTRACT

An apparatus and method for winding continuous webs onto a core mandrel wherein the web is in contact with a rotating winding drum and is guided onto an empty core mandrel supported in a first operating position where winding is started and where a partially wound core mandrel is produced; the partially web-wound mandrel is transferred into a second operating position without interruption of coil formation when a predetermined coil of web has been formed; the web is cut by an automatic knife and the leading web edge produced is taken by another empty core mandrel supplied from a magazine into the first operating position; the fully wound coil is transferred from the second operating position to storage and the operating cycle is repeated; a force sensor is connected with the winding drum to measure the force that is exerted by the outer surface of the coil on the mandrel in the second operating position and a mechanical compensator is connected with the support that holds the mandrel in the second operating position; the output signal from the force sensor is fed into a control device that actuates the mechanical compensator to that the effective force exerted by the coil in the second operating position against the winding drum can be maintained at a predetermined value; and a drive is provided for central winding of the coil when in the second operating position.

12 Claims, 8 Drawing Figures

WINDING APPARATUS AND METHOD

BACKGROUND OF THE INVENTION (a) Field of the Invention

This invention relates generally to the manufacture of webs of material, notably polymer films, and specifically to an improved apparatus for, and method for, winding such webs or films so as to obtain coils or reels thereof for storage and/or further processing.

(b) Description of the Prior Art

Continuous winding machines, notably for winding of paper or polymer webs formed or processed continuously in a preceding production or finishing step are well known in the art: cf. U.S. Pat. Nos. 1,687,928, 2,915,255 and 3,494,566, and Swiss Patent No. 540,185.

The feature common to all prior art winders is a mechanism for receiving a substantially endless web or film material and for guiding such film or web onto an empty cylinder or tube (core mandrel) so as to form a coil or reel of the web that can be stored or used as a web-source for further processing, e.g. printing.

Prior art winders for a substantially automatic operation further include a mechanism for replacing web-wound core mandrels (reels) by empty core mandrels so as to enable continued winding, that is, without interrupting the web stream when a reel is discharged and an empty core mandrel is introduced. The operating sequence of such winders starting with the take-up of a leading edge of the moving web by an empty core mandrel and ending with cutting-off the web from the reel with concurrent formation of the next leading edge will be called a "cycle" herein.

Another characteristic feature of conventional winders is the type or mode of operation with regard to rotation of the core mandrel: one group of winder operates in a so-called "center winding" fashion, that is, by connecting the core mandrel with a drive acting substantially centrally upon the core mandrel so that the web is pulled thereon; the other group of winders operates in a so-called "surface winding" fashion, that is, by contacting a generally linear portion of the web surface on top of the core mandrel with a rotating winding drum; the winding drum is operated by drive and the web is "pushed" rather then pulled onto the core mandrel.

Generally, the surface winding fashion or mode of operation is preferred for winding of paper, such as in paper mills; this preference is understood when considering the mechanical properties of paper webs and the advantage of avoiding rupture of such webs due to pulling tension by applying but a "pushing" force that frictionally engages the coil surface.

Most winders in the plastics industry operate according to the surface winding mode as well and many polymer films or webs, such as, typically, polyalkylene films, can be wound on machines for the surface winding mode, either because such films have no or very little blocking tendencies per se or because their inherent blocking tendencies are substantially modified by the use of conventional slip additives.

When attempting to wind polymer films having a substantial blocking tendency on a surface-mode winder, the resulting coils—if they can be obtained at all—tend to lack in smoothness both of the layer structure of the reel or coil as well as of its surface structure. Such lack of smoothness indicates a deformation of the film and such deformed films tend to cause problems upon further processing, e.g. printing.

The blocking tendency of a web or film generally indicates a high coefficient of friction of the film; films with such properties are of growing importance as is the tendency to avoid use of slip additives. As a consequence, additional or supplemental winding machines are required that operate essentially in the center winding mode is smooth and, hence, undeformed layer structures are required for coils of high-friction films and/or those including no slip additive and two different types of winding machines would be, and in fact are, required for winding of different type of polymer films; such duplication of machines for a specific production or processing step is, of course, disadvantageous from an operating point of view, notably because typical steps preceding the winding, such as extrusion, do not generally require different apparatus for production of polymer films that have different frictional coefficients.

OBJECTS OF THE INVENTION

Therefore, it is a primary object of the invention to provide for a winder arrangement capable of operating both in the surface winding mode as well as in the center winding mode.

Another important object of the invention is to provide for a winder arrangement capable of operating in a mode that is intermediate between the normal surface winding mode and the normal center winding mode.

Yet a further object of the invention is to provide for a winder arrangement in which the force exerted by a web reel against a contacting winding drum can be controlled at a value between zero and a predetermined positive value independently from the weight of the web reel.

Still another object of the invention is to provide for a winding apparatus suitable for smooth winding of polymer films regardless of the frictional coefficient of the films.

Another object of the invention is to provide for an improved method of winding continuous polymer films onto a sequence of core mandrels.

Further objects will become apparent as this specification proceeds.

SUMMARY OF THE INVENTION

According to the present invention I have found that these objects will be achieved with a winding apparatus that has the elements required both for the surface winding mode of operation as well as for cycle repetition and additionally includes means for controlling the contact pressure between winding drum and coil surface, and means for rotatingly driving the coil when the coil drive by frictional contact between its surface and the winding drum is to be supplemented or replaced by a centrally acting drive.

When suitably controlling the contact pressure, such a winder apparatus is capable of operating either in the surface winding mode or the center winding mode, or in an intermediate mode and permits smooth winding of webs or various types of polymer films that have substantially different frictional coefficients and would require two different types of conventional winding machines. In addition, the use of an intermediate mode of operation between surface winding and center winding provides for optimum adaption of the winding operation to the specific frictional properties of the web of film that is to be wound. Such an intermediate mode cannot be achieved with conventional winders at all.

Accordingly, my invention further comprises a novel winding mode or method referred to herein as a "multi-mode" winding and a multi-mode winding apparatus.

According to a first embodiment, the invention provides for an apparatus that includes the elements of an automatic surface type winder, that is: a rotatable winding drum for engagement with the web; a core mandrel supply or magazine; a first support for receiving an empty core mandrel and for contacting it with the winding drum so as to start winding of the web onto the empty core mandrel and to produce a partially web-wound core mandrel; a second support for receiving a partially web-wound core mandrel from the first support and for maintaining the web-wound core mandrel near or in contact with the winding drum until a predetermined coil of web is formed on the web-wound core mandrel; a drive for the winding drum; an automatic cutter that is actuated when the predetermined coil has been formed and that produces a trailing edge and a leading edge of the web, the leading edge being taken up by another empty core mandrel in the first support; a first mechanism for transferring a partially web-wound core mandrel from the first support to the second support; and a second transfer mechanism for discharging a web-wound core mandrel with predetermined web coil from the second support; according to the invention, a force-sensor is provided and connected with the winding drum for sensing a force exerted against the winding drum by a web-wound core mandrel on the second support; further, a central core mandrel drive is provided in the second support so that a core mandrel provided therein will continue to take up web in the absence of a surface-driving contact with the winding drum; a force compensator that may be the actuator of the second transfer mechanism is arranged and can be operated to counter-act a force exerted against the winding drum by a web-wound core mandrel; the force-sensor is connected with the force-compensator so that the latter can be actuated to continuously or discontinuously counter-act the force exerted by a web-wound mandrel against the winding drum.

A suitable force-sensor may include one or more transducers for converting a mechanical displacement into an electric current; such sensors are known in the art. Preferably, two force-sensors are arranged at the bearing ends of the winding drum supported in a manner to permit limited displacement, e.g. against a spring, said displacement activating the sensor or sensors.

In general, each core mandrel support includes a pair of pivotable arms that are forked so as to be capable of receiving and holding the ends of a core mandrel; each pair of pivotable arms is connected with an actuating mechanism, e.g. a hydraulic or mechanical actuator, so that each core mandrel can be alternatingly positioned in a first or mandrel-holding position and a second position in which the mandrel is released for transfer or discharge, respectively. Preferably, the actuating mechanism for such movement of the pivotable arms of the second support is also used as the force-compensator that reduces the pressure of the coil in the second support against the winding drum. The uncompensated pressure (in kilograms per meter of the length of the "gap" or "contact line") may be in the range of several hundred kg/m, e.g. from 50 to 500 kg/m, while the compensated pressure may and generally will be substantially lower, e.g. in the range of from zero to 50 kg/m. When the pressure is compensated, frictional interaction, that is, the surface driving force, will be reduced commensurately and the core mandrel drive provided in the second support will cause winding by the center winding mode, or by an intermediate mode. When the pressure is compensated to zero, the apparatus operates substantially by the center winding mode alone.

According to a preferred embodiment as a method, the inventive winding process includes the following steps: guiding a leading web edge of a continuous web onto a rotating winding drum in contact with an empty core mandrel provided in a first winding position and winding the web onto the core mandrel to produce a partially web-wound core mandrel; transferring the partially web-wound core mandrel to a second winding position and continuing winding of the web onto the partially web-wound core mandrel in the second position; cutting the web when a predetermined coil of web has been formed in the second position so as to discontinue further winding of web on the predetermined coil and to provide another leading edge of the web; providing another empty core mandrel in the first winding position for contact with the other leading edge of the web and for producing another partially web-wound core mandrel while discharging the predetermined coil from the second winding position; and repeating such sequence of steps for continuously winding the web onto a series of core mandrels; according to the invention, the force or linear pressure exerted by the coil against the winding drum is controlled and maintained, at least during a time portion of the coil winding operation, at a predetermined value that may be constant or oscillating and, generally, is in the range of from zero to 50 kg/m; further, the second winding position is connected with a drive for windingly rotating a coil when in the second position.

BRIEF DESCRIPTION OF THE DRAWINGS

The invention will be better understood and objects other than those set forth above will become apparent when considering the following detailed description thereof. Such description makes reference to the annexed drawings, wherein.

DETAILED DESCRIPTION OF THE PREFERRED EMBODIMENTS

Figure 1:
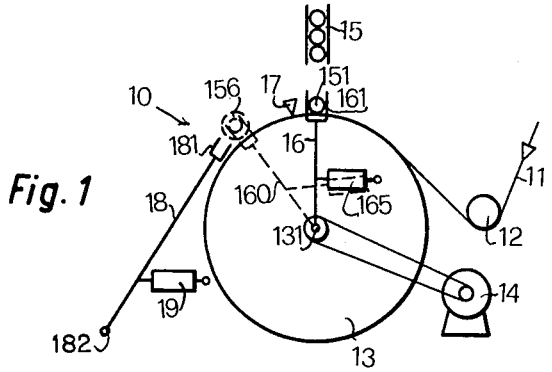
FIG. 1 is a diagrammatic illustration of a first operating stage of an automatic winding apparatus of the surface winding type according to the art.
Figure 2:
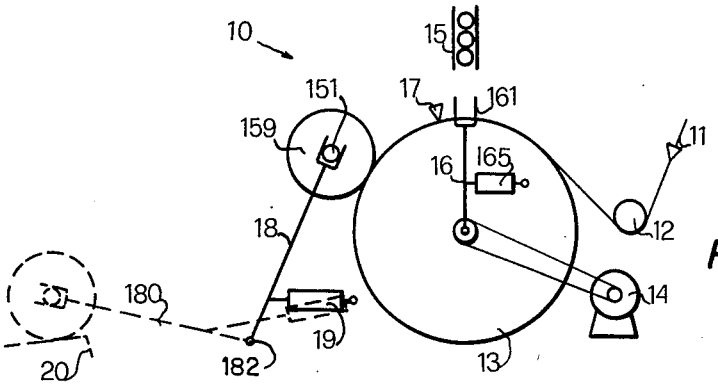
FIG. 2 is a diagrammatic illustration of the second operating stage of the winding apparatus depicted in FIG. 1.

FIGS. 1 and 2 of the drawings illustrate the operative elements of a prior art surface-mode winding apparatus 10 for continuously winding a web 11 supplied in a continuous manner from an extruder or the like source (not shown). Web 11 is deflected by a roller 12 for subsequent or down-stream contact with a winding drum 13, shown in FIG. 1 as rotating in counter-clockwise direction, and driven by a motor 14.

An empty core mandrel 151 is delivered from a core mandrel supply 15 into the forked end 161 of a first core mandrel support 16 that is movably supported at its other end near or at the rotational axis 131 of winding drum 13. In practice, such support will include a pair of arms. An actuator 165 is connected with support 16 so as to move and hold it in the positions required for winding and transfer. In general, support 16 will rotate together with cutter 17 rather then oscillate when moving from one operating position to the next operating position.

A winding cycle starts when cutter device 17 has cut the web 11 on winding drum 13 so as to produce a leading web edge (not shown). The empty core mandrel 151 in support 16 is provided with an adhesive so that the contacting web with its leading edge is wound around core 151 due to rotation of the contacting winding drum 13. A partially web-wound core mandrel 156 (including core 151 and a number of layers of web 11) is produced. The web length wound on empty core 151 to obtain a partially web-wound core 156 will in general be predetermined, e.g. by continuously measuring the web length supplied after cutting and operating actuator 165 by a signal caused when the predetermined length is achieved.

Upon such signal, actuator 165 pivots support 16 through position 160 indicated in broken lines and until the supporting ends of partially web-wound core mandrel 156 come to rest in the forked end member 181 of the second core mandrel support 18, which generally comprises another pair of pivotable arms with forked ends. Thus, the partially wound core mandrel 156 is transferred from its first winding position in support 16 to its second winding position in second support 18 where winding is continued as shown in FIG. 2.

First support 16 then reverts into its first winding position while a coil 159 of web 11 is built up around core 151 in the second winding position maintained by second support 18. Support 18 is pivotably supported at its lower end 182 so that the weight of coil 159 causes a continued frictional contact between a generally linear portion of the coil surface and the adjacent linear surface portion of winding drum 13. Due to continued rotation of drum 13, coil 159 is rotated or wound in the surface winding mode. Again, the length of web 11 fed onto coil 159 will be monitored in a manner known per se, and when a predetermined web length has been reached a signal from the monitoring device (not shown) will cause operation of cutter 17. Upon such operation or shortly before, another empty core mandrel will be discharged from core magazine 15 to first support 16 as shown in FIG. 1 and the next winding cycle begins with formation of another leading web edge that is taken up by the adhesive effect of the next empty core mandrel.

The trailing edge of web 11 from the preceding cycle is on coil 159 and second support 18 will now be caused to pivot into its discharge position 180 indicated in broken lines in FIG. 2. A coil receiving rack (not shown) may be provided as shown in Swiss Pat. No. 540,185 or an inclined surface 20 may be used on which the discharged coil may be caused to roll into a storage space or onto a transporting tray (not shown).

For reasons explained above, automatic winders operating by surface winding mode, i.e. the operation of the apparatus 10 of FIGS. 1 and 2, cannot generally be used for winding of webs that have a high coefficient of friction and tend to "block".

It should be noted here that the term "web" or "polymer film" as used herein in connection with the invention is intended to refer to continuous sheets or strata of various types and gauges. Polymeric films or sheets are preferred. Typical examples are polymer films, e.g. produced by melt extrusion or other methods of forming films, foils or sheets from generally thermoplastic polymers, such as polyethylene and other polyalkanes, copolymers, polymer blends and polymer compositions including conventional compounds and additives; other examples of sheet materials include coated materials with different types of substrates including polymer, paper or thin metal substrates coated on one or both surfaces by any suitable coating method with polymers, polymer compositions and the like film forming continuous web materials. The invention is of particular advantage for winding various and possibly varying webs obtained continuously from a given producing or processing plant, such as a blow extruder, regardless of varying frictional properties of the web. Thus, any webs capable of being wound either on conventional surface winders or on conventional center winders can be wound or coiled with the inventive apparatus. The web gauge may generally be in the range of from a few micrometers in the milli-inch range, e.g. 25 micrometers or less, to several hundred micrometers, say up to 800 micrometers or more.

Typical examples of low-friction webs include those made of, or coated with, polyalkene plus slip additive, cellophane, etc. Typical examples of high-friction webs are those made of, or coated with, hot-melting adhesives including ionomers such as SURLYN (reg. trade mark of E. I. Du Pont de Nemours) or other copolymers of acrylic or methacrylic monomers and alkylene monomers, etc.

Figure 3:
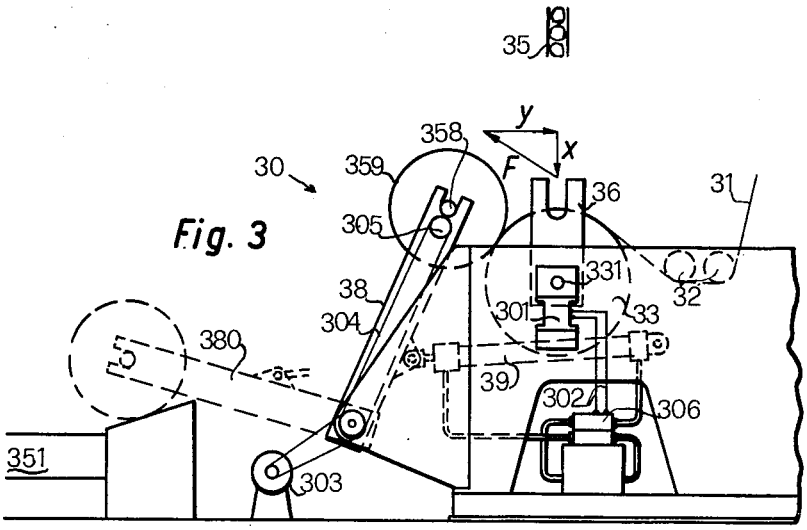
FIG. 3 is a semi-diagrammatic and simplified side view of a winding apparatus according to the invention.

According to the invention, webs of either type can be wound with an apparatus 30 of the type illustrated in FIG. 3 and including a winding drum 33 connected with a drive (not shown) as shown in FIG. 1 and comprising the other main operative elements of a surface winder, that is, deflector rolls 32, a core magazine 35, a first pivotable core support 36, a cutter (not shown), a second pivotable core support 38, a first actuator (not shown) for pivoting support 36, and a second actuator 39 for pivoting support 38.

However, apparatus 30 according to the invention further includes a force-sensing device 301 operatively connected with winding drum 33 for sensing the force (indicated by vector F shown in a displaced position) that is exerted by the generally linear surface portion of the coil that contacts the adjacent surface portion of winding drum 33.

The control portion 306 of a force-compensator 39 is connected via lines 302 with the force-sensing device 301. As will be noted, compensator 39 is the same as second actuator 39 for pivoting support 38. Such combination or integration is not critical but preferred for simplified construction only, and a separate compensator (plus control) might be used in addition to actuator 39 for pivoting the second core support 38.

As another essential additional element, the inventive apparatus 30 includes a core mandrel drive, e.g. a motor 303, a transmission 304 and a connector or clutch 305 for imparting a rotationally moving force to or near center 358 of coil 359. The direction of rotation caused by the core mandrel drive will generally be that opposed to the rotational direction of the winding drum. Means (not shown) for controlling the rotational speed of coil 359 caused by motor 303, e.g. for synchronization of peripheral speeds of coil 359 surface and the adjacent winding drum 33 surface, may be advantageous but self-controlling means such as a slip-clutch or the like might be used as well to obtain a desired amount of web pull by core mandrel drive 303.

When the compensator 39 is not actuated, coil 359 will pressingly engage a contacting line portion of drum 33, that is, will exert a force F against the winding drum and its supporting shaft 331. The shaft is connected with, or supported by, force sensor 301, and load or force F will act with its component forces y and x against a spring provided as a part of sensor 301 as explained in more detail below in FIG. 4.

The output signal from sensor 301 may now act upon control 306 of compensator 39 and, depending upon a desired setting, cause the latter to at least partially compensate force F. For example, compensator 39 may bear upon support 38 so that coil 359 exerts a substantially reduced force or linear pressure against drum 33, e.g. in the range of from zero to about 50 kg/m of contact length. As core 358 is in engagement with clutch 305 of the transmission 304 of core drive 303, coil 359 will continue to rotate in a web-winding manner and web 31 will continue to be built up in successive layers on coil 359 even if force F is compensated to the extent that there would be insufficient pull upon the web for smooth winding. In general, it will be preferred that the surface of coil 359 exerts some force in the range of up to about 50 kg/m, e.g. in the range of from about 1 to about 20 kg/m as this is generally advantageous for getting smooth coil surfaces.

Again, as explained in connection with FIGS. 1 and 2, after a predetermined length of web 31 is on coil 359, an automatic cutter (not shown in FIG. 3) will cut web 31 so as to discontinue further winding of coil 359 and to form another leading edge that will be taken up by the adhesive surface of another empty core mandrel from supply 35 in support 36. Actuator 39 will now pivot support 38 into discharge position 380 (shown in broken lines in FIG. 3) and coil 359 will roll onto tray 351.

Figure 4:
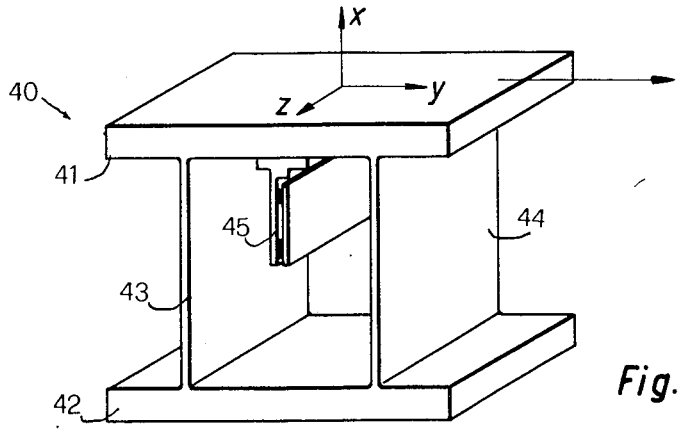
FIG. 4 is a perspective view of a force-sensor suitable for the purposes of the invention.

FIG. 4 shows a force-sensor 40 (electrical connectors omitted) suitable for use herein. As such sensors are known per se and can be obtained commercially (e.g. from the Reliance Electric Co., Cleveland, Ohio) only a short explanation of its function will be given here for illustration purposes, it being understood that other force-sensors are suitable for the invention.

Figure 5:
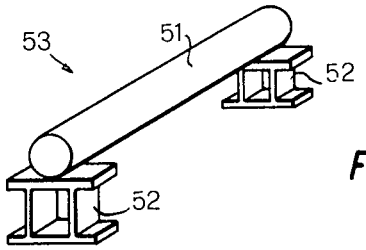
FIG. 5 is a diagrammatic perspective view showing two sensors of the type illustrated in FIG. 4 arranged to support a shaft portion of the winding drum.

Generally, sensor 40 includes two yokes 41, 42 and a pair of springs 43, 44 as well as a transducer 45 that converts a displacement of yoke 41 into a voltage (output not shown). Yoke 42 rests on a substantially immovable support (not shown), e.g. a frame portion of the winder 30 of FIG. 3, while yoke 41 supports an end portion of shaft 331 of winder 30. Now, any force component x, y or z, or any resultant of such components, will act upon springs 43, 44 and actuate transducer 45. While a single sensor 40 or the like device might be used in the invention, it is preferred for simplicity of construction to use a pair of sensors 40 near each end of the winder drum or its shaft. This is depicted diagrammatically in FIG. 5, where a roller or shaft 51 rests on two sensors 52, 53. For example, when the bearings of winder drum 33 of FIG. 3 are supported by sensors 52, 53 of FIG. 5 in the manner indicated by element 51, each sensor will be capable of signalling half of the force F indicated in FIG. 3.

Figure 6:
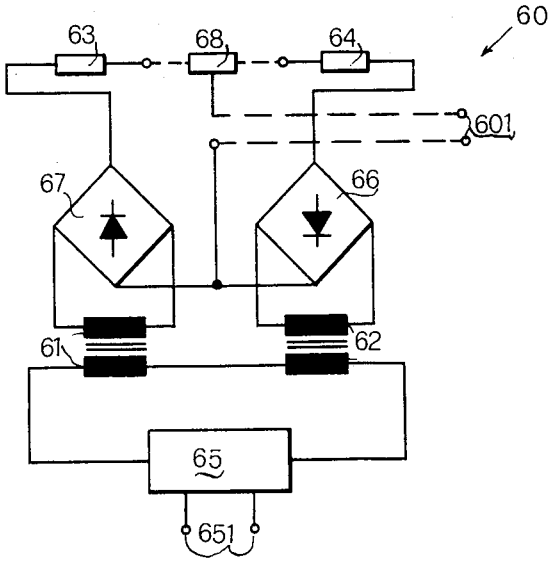
FIG. 6 is a circuit diagram for the force-sensor of FIG. 4.

FIG. 6 shows, for illustration purposes only, a circuit suitable for the transducer 45 of sensor 40 of FIG. 4. Bridge circuit 60 includes a pair of variable inductances 61, 62 that will change in proportion to the displacement of the transducer; two constant resistances 63, 64 are provided as well as an oscillator 65 supplying current to circuit 60 via feed lines 651. Two rectifiers 66, 67 are arranged for providing a DC-voltage at the output end 601. A potentiometer 68 serves to compensate the voltage of the bridge circuit or to compensate a preexisting load.

A stabilized feeding voltage of, for example, 12 V at 90 mA would require a 10 kΩpotentiometer and would generate an output signal voltage of from zero to 12 V.

While mechanical force sensors might be used for the invention, I prefer mechanical/electrical transducers as their output signal can easily be used to control the force compensator according to the invention.

Figures 7, 8:
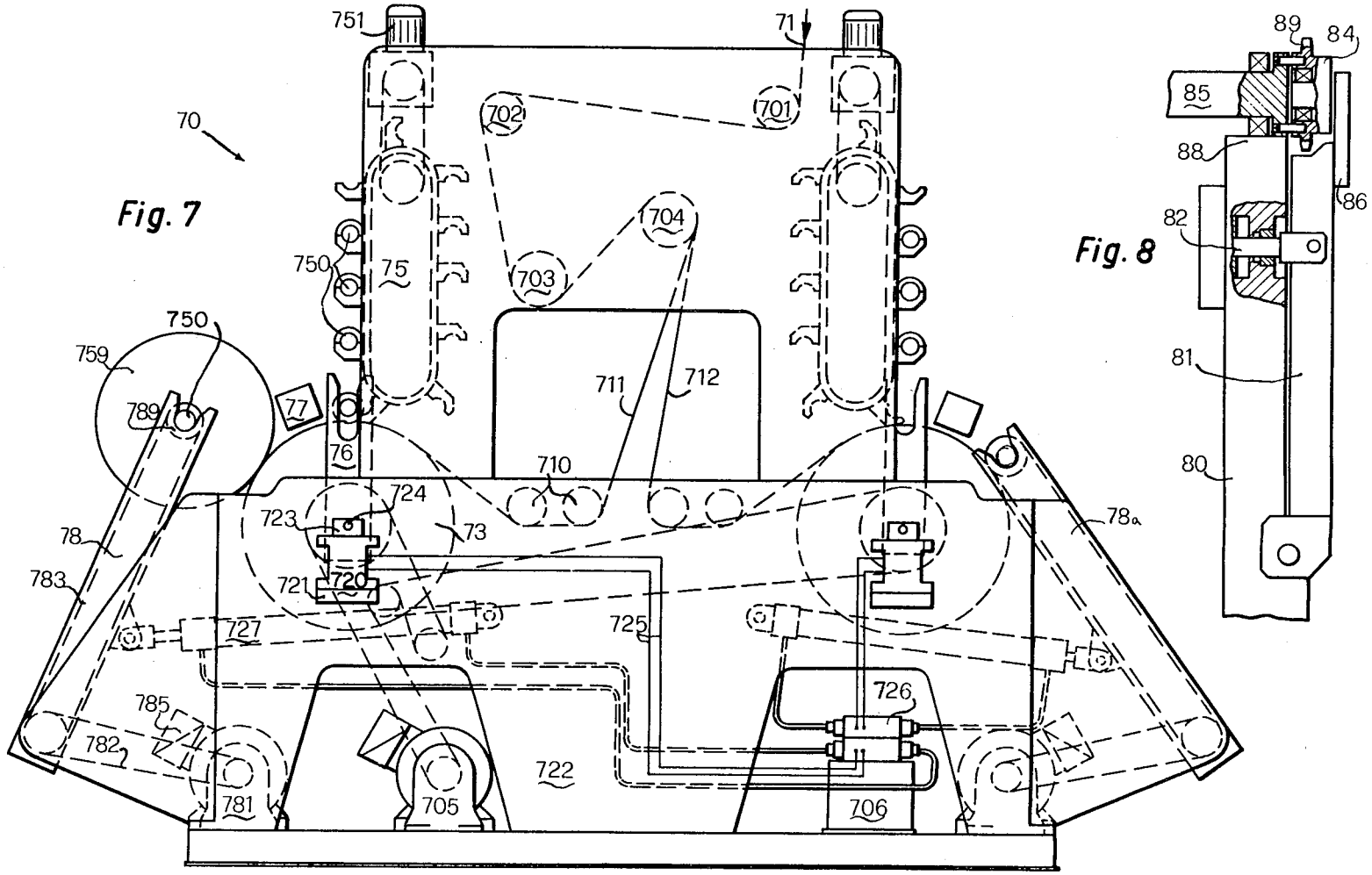
FIG. 7 is a semi-diagrammatic side view of a winding apparatus according to the invention.
FIG. 8 is a partially sectioned view of the connection between a core mandrel end and the corresponding receiving end of the second core mandrel support suitable for a winding apparatus of the invention.

FIG. 7 shows a semi-diagrammatic side view of an apparatus according to the invention for continuous and simultaneous winding the layers of a web pair onto two mandrel sequences. A pair of superimposed webs 71, e.g. a blown polymer film hose slit at both sides, is fed at production velocity into winder 70 and guided via deflecting rollers 701, 702, 703 to roller 704 where the double layer is separated into two web streams 711, 712 and the remainder of the apparatus is a twin-structure in that it has two sets of substantially same operating elements, one for each stream, and only some elements, such as the drum drive 72 and the hydraulic motor 706, are not duplicated. Such a twin installation is a preferred embodiment as winding of blown hose films from a conventional blowing extruder for continuous production of blown polymer films is an important film producing method. For simplification, only one set of the duplicated parts of the winder will be explained in more detail, however. Thus, one web 711 will be passed around a pair of deflecting rollers and guided into contact with winding drum 73 rotated by drive 705. Core supply 75, e.g. a chain conveyor operated by motor 751, contains a number of empty core mandrels 750 (in turn supplied from a source not shown) and provides in a step-wise manner one empty core mandrel at a time to the first core mandrel support 76 which is pivotable as explained above. The actuator for positioning support 36 as explained above is omitted from the drawing for simplification only. As before, the empty core mandrels are provided with adhesive to hold a leading web edge and to start winding of the mandrel in support 76 as soon as cutter 77 has cut the web supplied to coil 759 and a cycle has started.

First support 76 comprises two arms (only one shown) that have forked ends and are pivotable as explained above for movement into the position for start-up (as shown in FIG. 7) and the position for transfer of a partially wound mandrel to second support 78. In FIG. 7, the second support **78*a* is shown in the position when just having received a partially wound mandrel; support 78, on the other hand, carries a substantially completed coil 759 that—because of its accumulated weight—would exert a substantial force or linear pressure against winding drum 73**. While for some webs such pressure might be acceptable in view of resulting coil quality, many important types of polymer films would either yield low quality coils or could not be processed at all by a surface winder.

The inventive winder 70 has a force sensor 720 secured on a rigid mounting bracket 721 that is welded or in another way rigidly connected with the frame 722 of winder 70. The top of sensor 720 supports the corresponding bearing end 723 of shaft 724 of winder drum 73. Again, only one sensor at the front side is shown in FIG. 7 while the other sensor is arranged at the opposite side to support the other bearing end of shaft 724.

Now, when the force or linear pressure of coil 759 against winder drum 73 surpasses a predetermined value, e.g. 50 kg/m, the output signal from sensor 720 passing through lines 725 will activate control 726 which in turn actuates compensator 727, and the latter will counteract the force exerted by coil 759 against drum 73. Suitable means to operate hydraulic, pneumatic or other devices in response to a control signal are known in the art of automated control.

Also, selection of an optimum specific linear contact pressure, or a program for changing such pressure in accordance with the weight of coil 759, and/or in view of a given web material will be obvious to one experienced in the art, given the above general range and general operating objects.

Again, as explained above, a means for centrally driving a core mandrel 750 when in the second support is provided and includes a motor 781, a pivotable transmission comprising two belts or chains 782, 783 and a clutch 789. A motor control 785 may be provided to determine the speed of rotation of clutch 789 according to the coiled web length or, again, a slip clutch could be used to regulate the amount of pull effective upon the web.

FIG. 8 illustrates in a partially broken-away and fragmental view an example of a clutch construction for engagement of the second transmission belt with a core mandrel for centrally rotating same when in winding position of second support 78. An end portion of mandrel 88 is supported by the corresponding mandrel receiving end 88 of one arm 80 of the second support. A pivotable outer clutch bracket 81 can be engaged or disengaged by a push-rod 82 operated by a pneumatic actuator (not shown) and supports a rotatable receiving head 84 connected by an arm 86 with bracket 81. When in mandrel-receiving or coil-discharging position, clutch bracket 81 will be caused by push-rod 82 to pivot in an outward direction so that mandrel end 85 will be received by, or disengaged from, end 88. When a partially wound mandrel is transferred from the first mandrel support—e.g. when first support 76 in FIG. 7 pivots around shaft 724 towards second support 78—to the arm 80 of the second support, bracket 81 will be pivoted outwardly first and will then pivot inwardly into the position shown in FIG. 8 for engagement with the corresponding end of core mandrel 85. A gear wheel 89 on head 84 is connected with the transmission (not shown in FIG. 8) and will cause mandrel 85 to rotate in accordance with the core mandrel drive (not shown in FIG. 8).

It will be understood that one or both arms of the pivotable second support can be provided with a clutch of the type shown in FIG. 8 or an equivalent device. In general, a single clutch will be satisfactory.

It will also be understood that automatic control of the multi-mode winder according to the invention requires automatic control of a large number of functions, e.g. automatic supply of empty core mandrels to the core supply (35, 75), delivery of an empty core to first support (36, 76) at the cycle start, synchronization of speed of the winding drum (33, 73) with the speed of the web (31, 71), pivoting of first support (36, 76) for transfer of a partially wound core mandrel to the second support (38, 78), operation of the cutter (77) and pivoting of second support (38, 78) for discharge of the coil.

However, such control means and methods are known from the operation of conventional surface winders and suitable installations can be obtained commercially, e.g. from the above mentioned Reliance Electric Co. and the additional controls required for the multi-mode winders according to the invention can be carried out with similar devices. For example, synchronization of the core mandrel drive with the web speed can be effected in analogous manner, e.g. using speedometer devices and/or length-metering devices plus timers while pressure control means suitable to obtain the desired linear pressure between the coil and the winding drum are known from other web-processing applications, e.g. in the printing fields etc.

Suitable modifications could be made to the system described here without departing from the inventive concept of a dual-mode or multi-mode winder. So, while certain preferred embodiments of the invention have been explained in some detail for illustration, it is to be understood that the invention is not limited thereto but may be otherwise embodied and practiced within the scope of the following claims. Accordingly,

What is claimed is:

1. In an apparatus for continuously winding a web of material onto a series of core mandrels; said apparatus comprising: a rotatable winding drum for contacting engagement with said web and for guiding said web onto a core mandrel; a core mandrel supply; a first core mandrel support for contacting an empty core mandrel from supply with said winding drum to commence winding of said web onto said empty core mandrel and to produce a partially web-wound core mandrel; a second core mandrel support for receiving a partially web-wound core mandrel from said first core mandrel support and for maintaining said web-wound core mandrel near said winding drum until a predetermined coil of said web is formed on said web-wound core mandrel; a drive means associated with said rotatable winding drum for rotating same; a means for cutting said web after formation of said predetermined coil and for commencing said winding of said web onto another empty core mandrel; a first transfer means for transferring said partially web-wound core mandrel from said first mandrel support to said second mandrel support; and a second transfer means for discharging said web-wound core mandrel with said predetermined coil of said web thereon from said second core mandrel support; the improvement consisting of a force-sensing device in operative connection with said winding drum for sensing a force exerted against said winding drum by said web-wound core mandrel on said second core mandrel support when in contacting relation; a core mandrel drive means for rotating said web-wound core mandrel when on said second core mandrel support; a compensator means for counter-acting said force exerted against said winding drum by said web-wound core mandrel; and a means connected to said force-sensing device for actuating said compensator means so as to at least partially counter-act said force exerted against said winding drum.

2. The apparatus of claim 1 wherein said force-sensing device includes at least one transducer means for converting a mechanical displacement into an electric current, said transducer being operatively connected to said rotatable winding drum.

3. The apparatus of claim 2 wherein said rotatable winding drum is supported by bearings and wherein at least one of said bearings is in contact with said transducer means and is capable of a displacement against a spring-load.

4. The apparatus of claim 3 wherein said rotatable winding drum is supported by two bearings and wherein each of said two bearings is capable of said displacement and is connected with one of said transducer means.

5. The apparatus of claim 1 wherein said second core mandrel support includes a pivotable forked member for supporting end portions of said core mandrel and wherein said second transfer means includes an actuating device connected to said pivotable forked member for oscillating some between a first position where said web-wound core mandrel is in contact with said rotatable winding drum, and a second position where said pivotable forked member releases said web-wound core mandrel, said actuating device being operatively connected to said force-sensing device and being capable of serving as said compensator means when said pivotable forked member is in said first position.

6. In a method of continuously winding a web of material onto a series of core mandrels; said method comprising the steps of: guiding a leading edge of said web onto a rotating winding drum in contact with an empty core mandrel provided in a first core mandrel support and winding said web onto said core mandrel to produce a partially web-wound core mandrel; transferring said partially web-wound core mandrel to a second core mandrel support while continuing winding of said web onto said partially web-wound core mandrel near said rotating winding drum until a predetermined coil of web is formed on said web-wound core mandrel; cutting said web when said predetermined coil of web has been formed on said web-wound core mandrel to discontinue further winding of web thereon and to provide another leading edge of said web; providing another empty core mandrel in said first core mandrel support for contact with said other leading edge of said web and for producing another partially web-wound core mandrel while discharging said web-wound core mandrel with said predetermined coil from said second core mandrel support; and repeating such sequence of steps for continuously winding said web onto a series of core mandrels; the improvement consisting of connecting each core mandrel when in said second core mandrel support with a drive for rotatingly driving said core mandrel while said predetermined coil of web is formed thereon; and controlling the force exerted by said core mandrel in said second core mandrel support against said rotating winding drum so as to keep said force at a predetermined value.

7. The method of claim 6 wherein said force is controlled by measuring the load on said winding drum exerted by said web-wound core mandrel in said second support when in contact with said winding drum and by at least partially counter-acting said load.

8. The method of claim 7 wherein said force is kept at a predetermined value in the range of from about zero to about 50 kilograms per meter of contact length.

9. The method of claim 8 wherein said force is kept at a predetermined value in the range of from about zero to about 20 kilograms per meter of contact length.

10. The method of claim 9 wherein said force is kept at a predetermined value of about zero.

11. The method of claim 6 wherein said force is controlled to oscillate between about zero and 50 kg per meter of contact length.

12. A multiple-mode winder for continuously coiling at least one polymer web, said winder comprising a surface mode winding installation for winding at least one core mandrel in contact with a rotating winding drum; a sensor for measuring a linear pressure between said coil surface portion on said core mandrel; a compensator for at least partially counter-acting said linear pressure; and a drive for centrally rotating said core mandrel when said compensator at least partially counter-acts said linear pressure.

* * * * *

UNITED STATES PATENT OFFICE
CERTIFICATE OF CORRECTION

PATENT NO. : 4,191,341

DATED : March 4, 1980

INVENTOR(S) : GOTTLIEB LOOSER

It is certified that error appears in the above-identified patent and that said Letters Patent are hereby corrected as shown below:

In claim 5, line 6, the word "some" should be replaced by "same".

Signed and Sealed this

*Seventeenth* Day of *June 1980*

[SEAL]

*Attest:*

SIDNEY A. DIAMOND

*Attesting Officer*

*Commissioner of Patents and Trademarks*